United States Patent [19]

Meyers

[11] 4,183,458

[45] Jan. 15, 1980

[54] TRAY HAVING HINGED, RECLOSEABLE LID WITH LOCKING FEATURE

[75] Inventor: George L. Meyers, Menasha, Wis.

[73] Assignee: American Can Company, Greenwich, Conn.

[21] Appl. No.: 870,597

[22] Filed: Jan. 18, 1978

[51] Int. Cl.[2] ..... B65D 5/66; B65D 43/16

[52] U.S. Cl. ..... 229/44 R; 206/626; 206/629; 229/45 R

[58] Field of Search ..... 206/629, 621, 626, 631, 206/633; 229/43, 44 R, 45 R

[56] References Cited

U.S. PATENT DOCUMENTS

| | | | |
|---|---|---|---|
| 329,562 | 11/1885 | Howe | 229/44 R |
| 1,773,553 | 8/1930 | Taylor et al. | 206/621 |
| 2,124,868 | 7/1938 | Davidson | 206/631 |
| 2,664,237 | 12/1953 | Sanford | 206/633 |
| 2,923,453 | 2/1960 | Eckman | 229/43 |
| 3,061,087 | 10/1962 | Scrivens et al. | 206/633 |
| 3,101,870 | 8/1963 | Betner | 206/621 |
| 3,115,245 | 12/1963 | Schechter | 229/43 |
| 3,151,800 | 10/1964 | Griese, Jr. | 229/3.5 |
| 3,286,909 | 11/1966 | Scharre. | |
| 3,288,323 | 11/1966 | Schechter | 229/44 R |
| 3,298,505 | 1/1967 | Stephenson | 206/45.31 |
| 3,298,593 | 1/1967 | Stephenson | 229/43 |
| 3,399,820 | 9/1968 | Foster et al. | 229/37 |
| 3,464,832 | 9/1969 | Mullinix. | |
| 3,521,809 | 7/1970 | Zimmerman | 229/17 |
| 3,526,353 | 9/1970 | Jaeschke. | |
| 3,610,410 | 10/1971 | Seeley | 206/44.12 |
| 3,721,380 | 3/1973 | Meyers | 229/15 |
| 4,043,503 | 8/1977 | Meyers et al. | 206/613 |
| 4,119,203 | 10/1978 | Kuchenbecker | 206/461 |

FOREIGN PATENT DOCUMENTS 741190 8/1966 Canada.

*Primary Examiner*—Stephen P. Garbe
*Attorney, Agent, or Firm*—Robert P. Auber; Ira S. Dorman; George P. Ziehmer

[57] ABSTRACT

A container having a tray portion and a cover sealed to the peripheral top edges of the tray. Cut score lines on the inner side of the cover provide a splitting of the paperboard of the cover upon opening to allow the cover to be peeled from the tray to a hinge at the back edge of the tray. Offset double cut score lines may be provided on the upper and lower sides of the cover at the front edge of the tray, which will split upon opening of the cover to yield overlapping locking flaps which can be used to reclose the cover. Flanges may be attached to the lateral side edges of a paperboard tray by cut score hinges, and adhered to the inner side of the cover to provide layer separation of the flanges upon opening rather than layer separation of the cover. Alternatively, double cut score lines can be formed along the lateral sides of the cover in position to register with lateral side flanges on the tray, which split and provide overlapping locking flaps when the cover is opened. The cover can then be completely removed from the tray upon opening, and is reclosed by inserting the locking flaps on the removed portion of the cover under the locking flaps projecting from the tray.

10 Claims, 21 Drawing Figures

TRAY HAVING HINGED, RECLOSEABLE LID WITH LOCKING FEATURE

BACKGROUND OF THE INVENTION

1. Field of the Invention

This invention pertains generally to containers having an open tray portion and a cover which is normally sealed on the tray.

2. Description of the Prior Art

Numerous carbons and container designs have been developed which utilize a cover glued or otherwise adhered to a tray. Generally, the cover is destroyed upon opening or is incapable of being reclosed in a locking position onto the tray portion of the container. Reclosure of such cartons usually requires specially formed locking tabs which add additional steps to the manufacturing process of the container. The steps become particularly involved with regard to so-called thermo-formed plastic "blister" trays which must be covered by a paperboard cover.

SUMMARY OF THE INVENTION

The container of this invention has a formed tray portion and a cover portion which is sealed thereto to entirely cover the open top of the tray and protect the contents. The container is opened by a user by pulling a portion of the cover away from the tray. The tray has outwardly extending flanges along its top peripheral edges which are sealed to the inner side of the cover. In one embodiment of the invention, the inner surface of the cover is cut scored adjacent to the peripheral edges of the tray, such that opening of the tray causes splitting of the layers of the cover above the flanges of the tray to allow a clean parting of the cover from the tray without ripping the entire cover. In another embodiment of the invention, a tray formed of paperboard has peripheral flanges attached along its top edges by cut score hinge lines, with these flanges being adhered to the inner side of the cover. Upon opening, the layers of the paperboard flanges split, with half of the flange layer adhering to the cover and the other half remaining attached to the top edge of the tray. With either construction, the break away of the cover from the tray is clean and precise, with very little chance of accidental ripping of the cover by the user as the cover is pulled open. Moreover, separation of the cover from the tray in this manner provides a remaining cover with structural integrity, which may thus be utilized for reclosure of the cover onto the tray by suitable means to maintain storage of articles within the container after initial opening.

The cover can be hingedly attached to the tray by a fold line or hinge line coincident with one of the top edges of the tray, such that the cover is split from the tray at the other peripheral edges but rotates upwardly about its hinge line without being completely removed from the tray. The hinge may be formed by providing a score line on the inner surface of the cover at a position adjacent to a back edge of the tray, with the portion of the cover extending outwardly from the score line being adhered to a flange extending from the back edge of the tray. The cover is opened by splitting all of the peripheral edges of the cover away from the tray except at the back edge, where the cover rotates about the partial thickness hinge provided by the score line. Utilizing a paperboard tray, the cover may be left unscored at the back edge of the tray, with the hinge being provided by the cut score hinge attachment between the back tray edge and the flange extending therefrom, wherein the flange is adhered to the bottom surface of the cover. In a carton formed from a unitary blank, the cover is connected by a fold line or other hinge line of weakness at the intersection between the back edge of the tray and the cover.

Because the cover is not ripped or damaged upon opening, it can be utilized for reclosure upon the tray to store unconsumed articles within the container. For example, containers of this nature may be utilized for packaging crumb cakes, other bakery and pastry goods, and similar fresh products, where it is desirable to be able to provide a tight reclosure of the container to preserve the freshness of the contents. As indicated above, the cover is initially sealed to the tray around substantially its entire top periphery. Offset inside and outside double cut score lines are formed in the cover at a position adjacent to at least one of the peripheral edges of the tray. For example, where the cover is hingedly connected to the tray at a back edge, the cover has offset double cut scores formed therein adjacent to the opposed front edge of the tray. Upon opening, the paperboard material of the cover splits between the offset cut score lines to form overlapping locking flaps on the portion of the cover pulled away from the tray and on the portion that remains adhered to the tray.

Reclosure of a cover portion which has been completely removed from the tray may be provided by utilizing a pair of double cut scores in the cover at positions adjacent to the lateral side edges of the tray. Upon removal of the cover, the paper splits between the double cut score lines to form overlapping locking flaps on the lateral side edges of the tray and on the lateral sides of the portion of the cover that has been removed from the tray. The locking flaps on the cover may then be inserted under the corresponding locking flaps projecting from the tray to hold the cover in position covering the open top of the tray.

The initial removal of the cover from the tray is preferably accomplished by peeling back the cover at one of the corners of the tray. To facilitate such removal, a portion of a lateral side flange of the tray is notched inwardly, and a small portion of the flange surrounding the notch is left unadhered to the cover in contact therewith. This allows the user to place a finger on the cover at the position of the notch and easily peel the cover back away from the tray with minimal damage to the structural integrity of the cover.

Further objects, features, and advantages of the invention will be apparent from the following detailed description taken in conjunction with the accompanying drawings showing preferred embodiments of a container in accordance with the invention.

DESCRIPTION OF THE PREFERRED EMBODIMENTS

Figure 1:
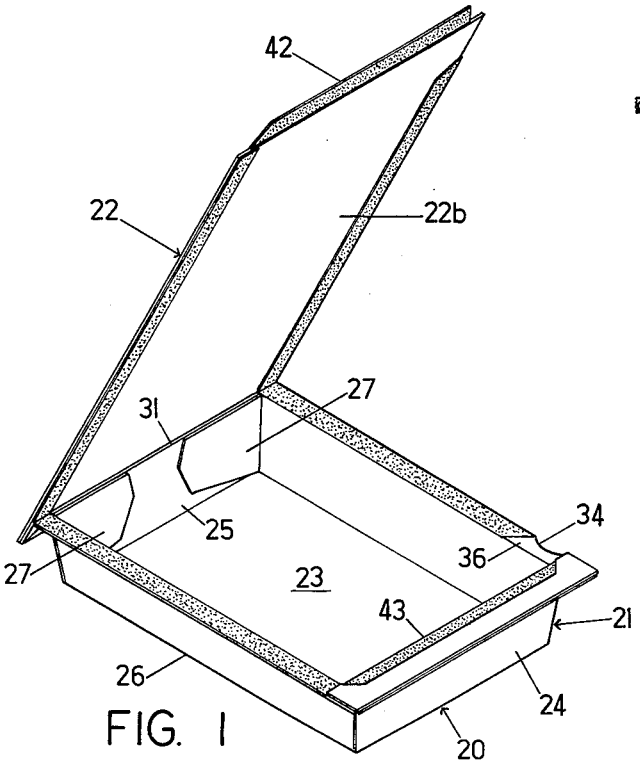
FIG. 1 is an isometric view of an opened container embodying the principles of the invention.

Referring now more particularly to the drawings, wherein like numerals refer to like parts throughout the several views, a first preferred embodiment of a container in accordance with the invention is shown generally at 20 in the isometric view of FIG. 1. The container 20 is shown in FIG. 1 in its condition after opening, with the contents having been removed from the tray portion 21 of the container. A cover 22 is normally sealed on the tray during shipment and storage, and is peeled off the tray by a user and rotated upward to its open position as shown.

Figure 2:
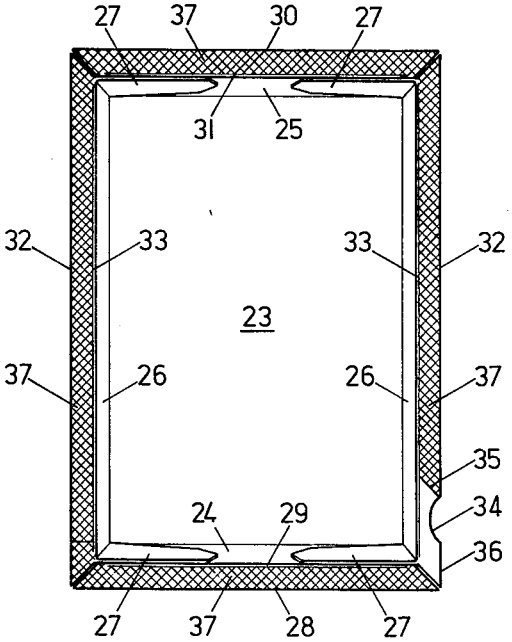
FIG. 2 is a top plan view of the tray portion of the container of FIG. 1, shown in its form before attachment of the cover thereto.

The tray has a bottom panel 23 and a front panel 24, back panel 25, and a pair of lateral side panels 26, each hingedly connected to the bottom panel. The various panels are assembled to form the open topped tray shown, with glue tabs 27 hingedly connected to the ends of the side panels and glued to the front and back panels respectively to provide rigidity to the tray structure. As best shown in FIG. 2, the tray includes a front flange 28 connected by a front edge cut score hinge line 29 to the front panel, a back flange 30 connected by a back edge cut score hinge line 31 to the back panel, and a pair of lateral side flanges 32 connected by lateral edge cut score hinge lines 33 to the respective lateral side panels. An indented notch 34 is formed in one of the lateral side flanges 32 near the front of the tray to provide a space for opening the cover by the finger of the user when the container has been sealed. A cut score line 35, formed across the width of the flange, separates an area 36 proximate to the notch 34 from the remainder of the flange. The area 36 is preferably left unadhered to the cover, whereas the remaining top areas 37 of each of the flanges has adhesive or a heat sealable coating applied thereto. When the cover 22 is in place on the tray in proper position, all of the areas 37 are sealed to the cover. If a heat seal adhesive or coating is used, a hot die is applied around the edges of the cover and the flanges to cause activation of the heat sealable coating, which may be a low melting point plastic such as low density polyethylene, polypropylene, or ethylene vinyl acetate.

Figure 3:
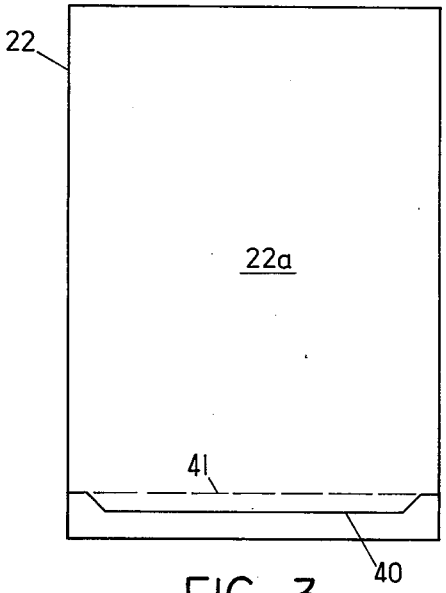
FIG. 3 is a plan view of the outer side of the cover portion of the container of FIG. 1.
Figure 5:
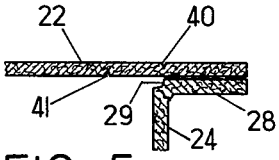
FIG. 5 is a partial cross-sectional view of the front of the container of FIG. 1, showing a portion of the tray with the cover sealed thereto.
Figure 6:
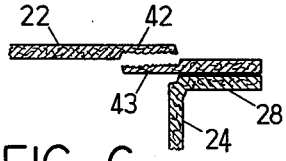
FIG. 6 is a partial cross-sectional view as in FIG. 5, shown with the cover separated from the tray.
Figure 4:
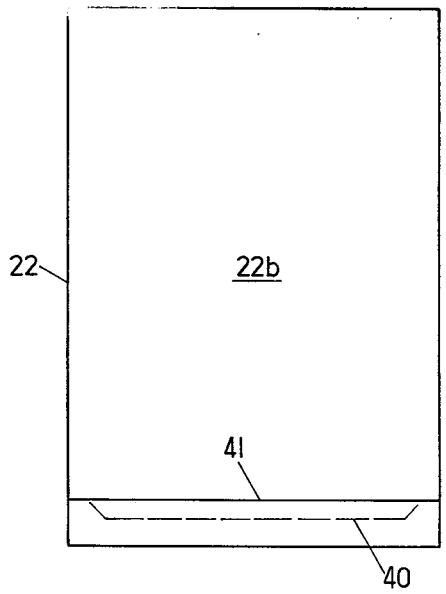
FIG. 4 is a plan view of the inner side of the cover portion of the container of FIG. 1.

The outer side **22*a* of the cover has a first score line 40 formed therein, whereas an offset cut score line 41 (shown in dashed lines in FIG. 3) is formed in the inner side of the cover at a position spaced inwardly from the first cut score line. The position of the inner surface cut score line 41 is best shown in the view of FIG. 4 which shows the inner side 22*b* of the cover, and in which the first cut score line 40 is shown in dashed lines for purposes of illustration. The score lines 40 and 41 are double cut score lines of the type that are offset from one another and which are cut only partially through the opposed surfaces of the paperboard. The arrangement of these cut scores is best shown in the views of FIGS. 5 and 6, which are cross sectional views through the tray and cover at the front of the container. The cover and tray are shown in adhered relation in FIG. 5, and are shown in FIG. 6 after the cover has been pulled away from the tray with the result that the paperboard cover splits between the cut scores 40 and 41 to provide overlapping partial thickness locking flaps 42 and 43. The cover can be easily reclosed, as is apparent from FIG. 1, by inserting the flap 42 remaining on the cover underneath the complimentary mating flap 43 which has remained adhered to the tray. Because the flaps 42 and 43** are of partial thickness, they are relatively flexible, and can be easily bent to slip under one another.

Figure 7:
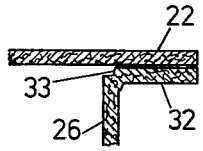
FIG. 7 is a partial cross-sectional view of a lateral side of the container of FIG. 1, showing a portion of the tray with the cover sealed thereto.
Figure 8:
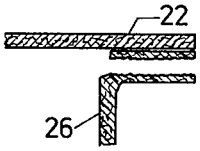
FIG. 8 is a partial cross-sectional view as in FIG. 7, shown with the cover separated from the tray.

The breaking of the seal between the cover and the lateral side flanges 32 is best shown with reference to the views of FIGS. 7 and 8, which show partial cross sections through the lateral sides of the tray and cover. In FIG. 7, the cover 22 is shown adhered to the flange 32 by an adhesive or other suitable sealing means. For example, a heat sealable coating such as low density polyethylene could be applied over the inner side **22*b* of the cover and over all of the inner surfaces of the tray including the surfaces 37 of the flanges. A heat sealing die (not shown) could then be used to seal around the entire periphery of the container (except at the area 36) to provide melting of the heat sealing coating and adherence between the cover and tray. Because the flanges 32 are defined between the cut score lines 33 and the cut outer edges of each flange, the flanges will split upon opening of the cover 22 with partial adherence of a portion of the flange to the periphery of the cover, as shown in FIG. 8**.

As indicated above, the user opens the sealed container by placing his thumb at the cut out notch 34 and pulling up on the cover to cause splitting of the peripheral edge surfaces around the tray and upward rotation of the cover around the hinge line 31 at which the back flange 30 (now attached to the cover) is hingedly attached to the remainder of the tray. Reclosure is obtained by rotating the cover downward and slipping the locking flap 42 under the mating locking flap 43.

Figure 9:
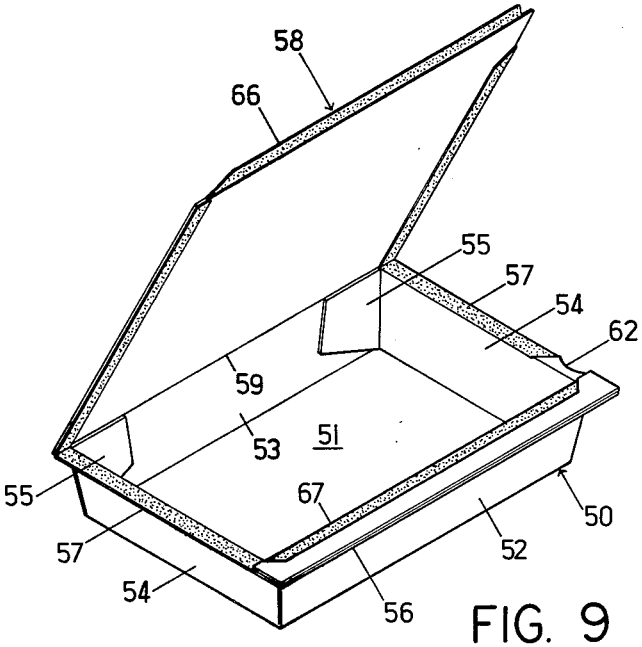
FIG. 9 is an isometric view of an opened container in accordance with the invention which is formed from a unitary blank.

A version of the sealed container which can be formed from a unitary blank is shown generally at 50 in FIG. 9. The container 50 is formed substantially the same as the embodiment shown in FIG. 1, and has a bottom panel 51, front panel 52, back panel 53, and a pair of lateral side panels 54 having glue tabs 55 hingedly connected to the ends thereof and glued to the front and back panels to provide a rigid carton structure. The container 50 also has a front flange 56 and lateral side flanges 57, which are formed identically to the flanges 28 and 32 respectively of the container 20 shown in FIG. 1. A cover portion 58 is attached by an integral hinge or fold line 59 to the top edge of the back panel 53. The cover 22 has offset double cut score lines 60 and 61 on the outside and inside surfaces of the cover, respectively, formed in a manner identical to that of the cut score lines 40 and 41 of container embodiment 20.

Figure 10:
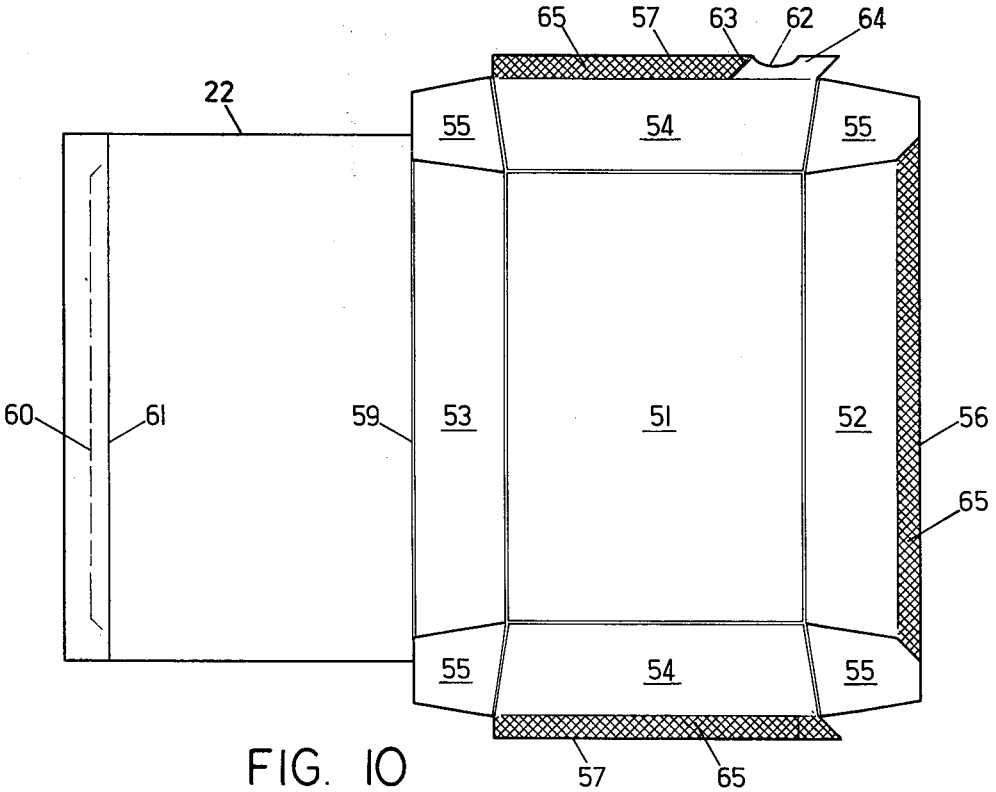
FIG. 10 is a plan view of a carton blank for forming the container of FIG. 9.

One of the lateral side flanges 57 has a cut out notch 62 therein and a cut score line 63 separating the area 64 surrounding the notch from the remaining surface area of the flange. The remaining surfaces 65 of the flanges have adhesive or heat sealable coatings applied thereto, to provide a means for sealing the cover to the tray portion of the container when the blank of FIG. 10 has been assembled as shown in FIG. 9. The user inserts a finger in the notch 62 and pulls upwardly on the cover 58 to cause separation of the layers of the lateral flanges 57, and to cause splitting of the cover between the offset cut score lines 60 and 61 to provide overlapping locking flanges 66 and 67 on the cover and tray portions respectively. The cover rotates upwardly about the hinge or fold line 59, and may be reclosed by tucking the flap 66 under the corresponding mating flap 67 which remains attached to the tray portion. Thus, the function and structure of the container embodiment 50 is entirely the same as the container embodiment 20 except that the cover 58 is directly connected by the hinge line 50 to the tray, rather than being connected to the back flange 37 of the container 20.

Figure 11:
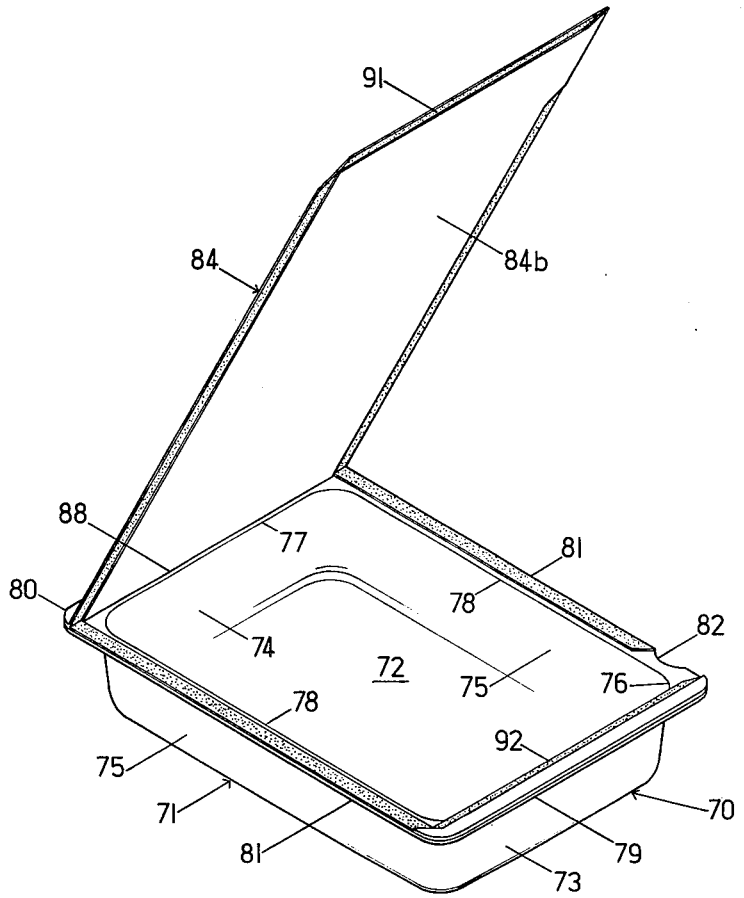
FIG. 11 is an isometric view of an opened container in accordance with the invention which utilizes a thermo-formed plastic tray and a paperboard cover.

A modification of a container in accordance with the invention is shown generally at 70 in FIG. 11, wherein a thermo-formed plastic "blister" type tray 71 is utilized. The tray 71 may be formed of any conventional plastic material and in any conventional manner, and for illustrative purposes has been shown in FIG. 11 as unitary structure having a bottom 72, front panel 73, back panel 74, and side panels 75. It is understood that plastic structures of any form could be utilized, including those having multiple interior compartments and various exterior wall dimensions. However, any such tray will include a top peripheral edge including a front edge 76, back edge 77 and lateral side edges 78. A continuous flange is formed around the top periphery of the tray, including a front flange 79, a back flange 80, and a pair of lateral side flanges 81. An indented notch 82 is formed in one of the lateral side flanges toward the front of the tray.

Figure 12:
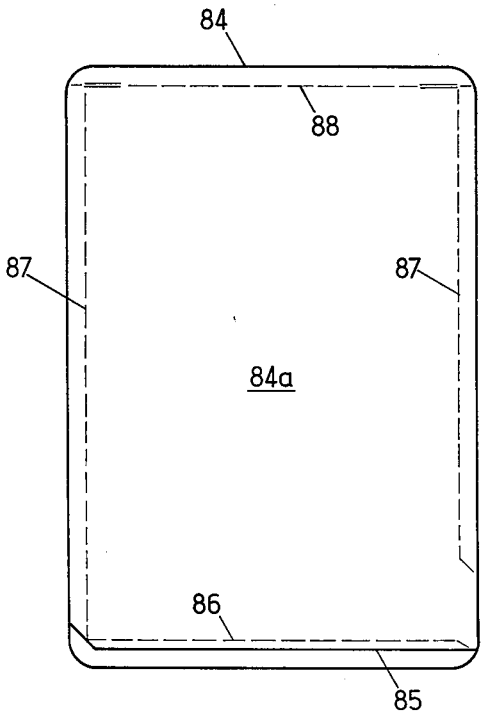
FIG. 12 is a plan view of the outer side of the cover portion of the container of FIG. 11.
Figure 13:
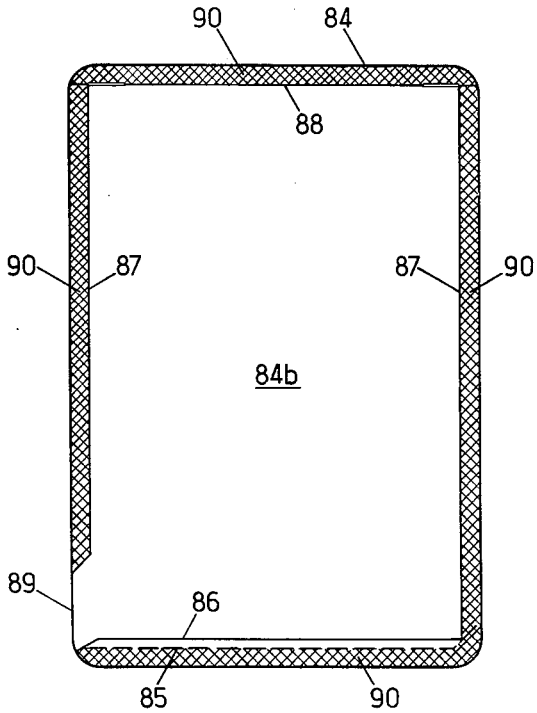
FIG. 13 is a plan view of the inner side of the cover portion of the container of FIG. 11.

A paperboard cover 84 is adhered to the peripheral flanges of the tray in position to entirely cover the open top of the tray. The outer side **84*a* of the cover is shown in FIG. 12, and includes a first score line 85 cut into the upper surface of the cover and extending across the width of the cover near the front. When placed upon the tray, the score line 85 will approximately coincide with the underlying front edge 76 of the tray. A second offset cut score line 86 (shown in dashed lines in FIG. 12) is cut into the inner surface 84*b* at a position spaced inwardly of the first cut score line 85. The inner side of the cover also is provided with lateral side cut score lines 87 spaced inwardly from the lateral edges of the cover, and a back cut score hinge line 88 spaced away from the back edge of the cover. The cut score line 88 acts as a hinge about which the cover 84 may be rotated upon opening. One of the lateral side cut score lines 87 does not extend all the way to the end of the cover, but terminates outwardly to the outer edge of the cover to provide an area 89 which is integrally connected with the remaining inner side of the cover. The areas 90 between the edges of the cover and the cut score lines are coated with adhesive or a heat sealable coating which can be activated to provide adhesion to the flanges of the tray. The area 89 overlays the opening notch 82, and does not have an adhesive applied thereto so that the cover is not sealed to the tray in the area immediately adjacent to the opening notch. As shown in FIGS. 12 and 13, the outer cut score line 85 intersects the inner cut score line 86 at its ends to allow splitting of the paperboard between these cut score lines upon opening of the cover. As shown in FIG. 13, the cover is adhered to the front flange only at the adhesive coated area 90 between the outer cut score line 85** and the edge of the cover.

Figure 14:
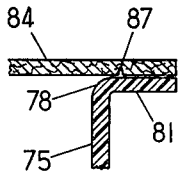
FIG. 14 is a partial cross-sectional view of a lateral side of the container of FIG. 11, showing a portion of the tray with the cover sealed thereto.
Figure 15:
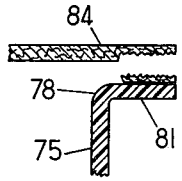
FIG. 15 is a partial cross-sectional view as in FIG. 14, shown with the cover separated from the tray.

The user grasps the cover above the open notch 82 to pull the same away from the tray, thereby splitting the paperboard material of the cover along its periphery where it is adhered to the flanges of the tray. The splitting of the material of the cover is best shown with reference to FIGS. 14 and 15. As shown in FIG. 14, the cover 84 is adhered to the lateral flanges 81 in the area outside the cut score 87. As the cover is pulled open, it splits at the flange to leave approximately half of the thickness of the cover adhered to the flange 81. Along the front edge of the tray, the offset double cut score lines 85 and 86 cooperate to split the cover in the area therebetween to provide overlapping locking flaps 91 and 92, projecting from the open portion of the cover and from the tray respectively. The cover rotates open about the hinge line 88. The hinged connection between the cover and the back flange 80 will be maintained as long as the user does not deliberately rip off the cover. Reclosure is obtained by rotating the cover downwardly and inserting the locking flap 91 under the locking flap 92 which projects inwardly from the tray.

Figure 16:
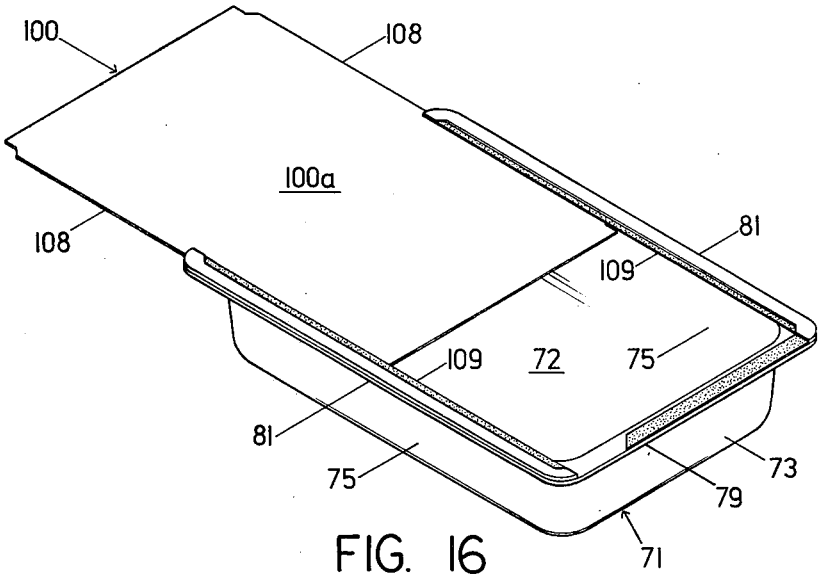
FIG. 16 is an isometric view of another container in accordance with the invention utilizing a formed plastic tray portion and a paperboard cover portion, wherein the cover may be completely removed and reclosed.
Figure 17:
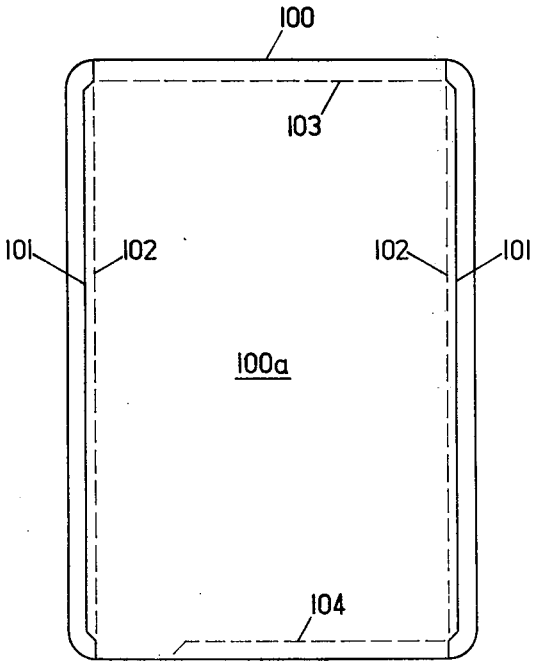
FIG. 17 is a plan view of the outer side of the cover portion of the container of FIG. 16.
Figure 18:
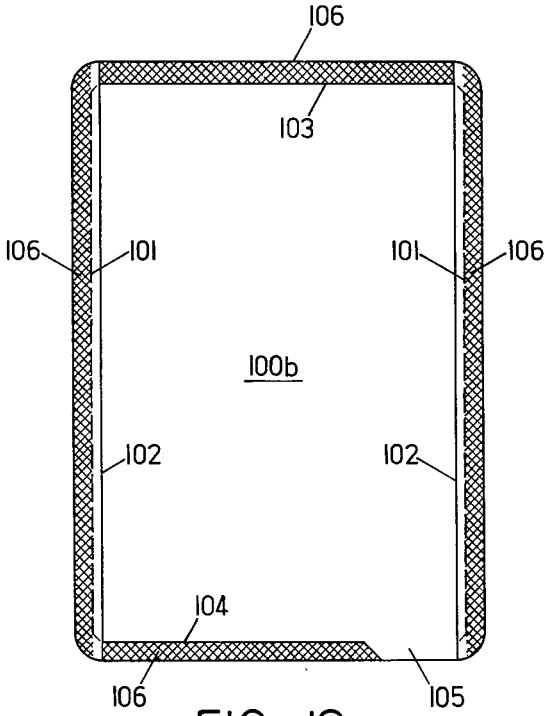
FIG. 18 is a plan view of the inner side of the cover portion of the container of FIG. 16.

A modified version of the container using the formed plastic tray 71 of FIG. 11 is shown in FIG. 16. The tray 71 is identical, having a bottom 72, front panel 73, back panel 74 (not shown in FIG. 16), lateral side panel 75, and integrally formed front flange 79, back flange 80 (not shown in FIG. 16) and lateral side flanges 81. The container embodiment shown in FIG. 16 has a cover 100 normally covering and sealed onto the open top of the tray 71, with a portion of the cover being completely removable to expose the contents of the tray. The outer side **100*a* of the cover is shown in FIG. 17. A pair of score lines 101 are cut into the outer side of the cover at a position parallel to and spaced inwardly of the lateral sides of the cover, and extend from the front edge to the back edge of the cover as shown. The cut score lines 101 are positioned such that they will be substantially coincident with the lateral edges of the tray when the cover is placed in its sealed position on the tray. A second pair of cut score lines 102 are cut into the inner side 100***b* of the cover (shown in dashed lines in FIG. 17) and are parallel to and spaced inwardly of the first cut score lines 101. As shown, the cut score lines 102 preferably extend from the front to the back edge of the cover. A score line 103 is cut in the inner side of the cover connecting the cut score lines 102, and is spaced away from the back edge of the cover at a position such that the score line 103 will be approximately coincident with the back edge of the tray when the cover is in sealed position on the tray. Another score line 104 is cut into the inner side of the cover and extends from one of the score lines 102 partially across the width of the cover and turns outwardly to terminate at the front edge of the cover. The cut score line 104 is positioned such that it will be substantially coincident or slightly outward of the front edge of the tray when the cover is in sealed position on the tray. Because the cut score line 104 does not extend all of the way across the width of the tray, there is an area 105 adjacent to the end of the tray which is integral with the remainder of the inner side 100*b*. The areas 106 between the cut score lines on the inner side and the edges of the cover are provided with an adhesive or are coated with a heat sealable coating such that they can be made to adhere to the respective underlying flanges of the tray. The area 105 does not have an adhesive or heat sealable coating applied thereto, and can be easily peeled away from the flange of the tray to provide opening and detachment of the cover from the tray.

The offset double cut score lines 101 and 102 cooperate to provide splitting of the cover therebetween during the opening process. The result is that the lateral sides of the open portion of the cover have extending partial thickness locking flaps 108 which are complimentary to and mate with partial thickness locking flaps 109 extending inwardly from the lateral edges of the tray. The cover portion can be reclosed onto the tray by slipping the locking flaps 108 under the corresponding flaps 109 and sliding the cover back in in a manner shown illustratively in FIG. 16.

In both container embodiments utilizing the plastic tray 71, the outside periphery of the paperboard cover is shown in substantial registry with the outside periphery of the flanges to facilitate splitting between the inner cut score lines and the edges of the cover. However, it is apparent that entirely equivalent splitting would occur if the cover were wide and outer cut score lines were formed therein in registry with the outside edges of the flanges at which the cover is intended to split.

Figure 19:
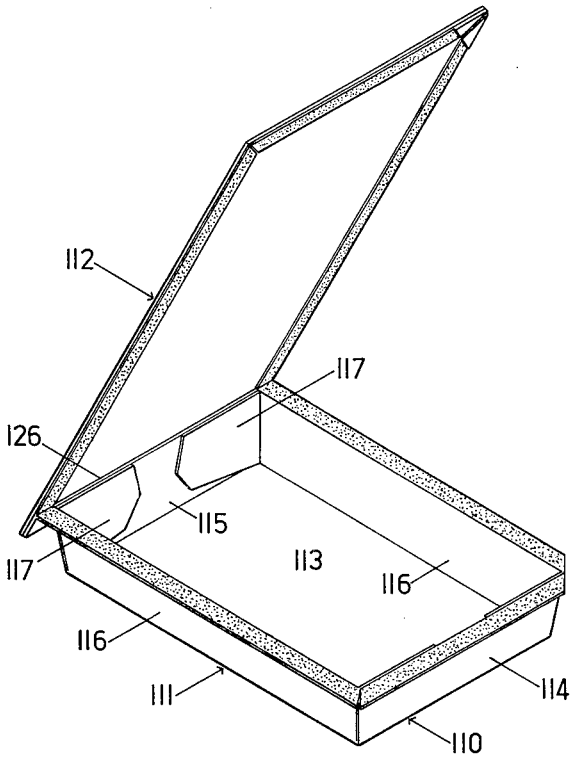
FIG. 19 is an isometric view of a further embodiment of a container in accordance with the invention which utilizes an alternative opening tab feature.
Figure 20:
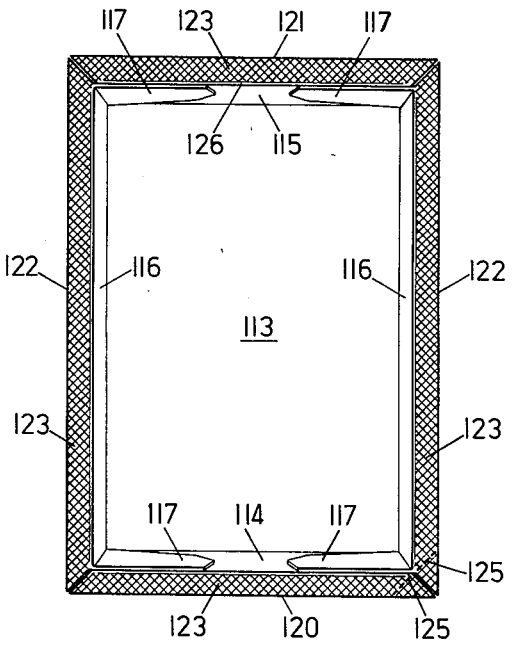
FIG. 20 is a top plan view of the tray portion of the container of FIG. 19, shown in its form before attachment of the cover thereto.

A further version of my sealed container which does not utilize a reclosing feature is shown generally at 110 in FIG. 19. The container 110 includes a tray portion 111 and a cover portion 112 adhered thereto which covers the contents during transit and storage.

Figure 21:
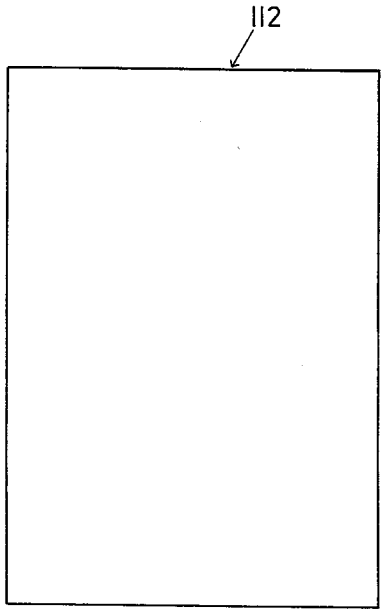
FIG. 21 is a plan view of the outer side of the cover portion of the container of FIG. 20.

The tray 111 includes a bottom panel 113, a front panel 114, a back panel 115, and a pair of side panels 116, all hingedly connected together in a manner well known in the art and illustrated for the container embodiment 20 of FIG. 1. The lateral side panels 116 have glue tabs 117 hingedly connected to the ends thereto, which are themselves adhered to the front panel and back panel respectively to provide a rigid carton structure. A front flange 120, back flange 121, and a pair of side flanges 122 are attached by cut score hinges to their respective front, back, and lateral side panels. The top surfaces 123 of the flanges have adhesive applied thereto or are coated with a heat sealable coating, to provide adhesion over the entire top surface areas of the flanges to the cover. As shown in FIG. 21, the cover 112 is a unitary one piece paperboard structure which is adapted to entirely cover the open top of the tray as well as the top surfaces of the flanges.

To facilitate opening of the cover, a line of perforations 125 is cut diagonally through the front flange 120 and one of the lateral side flanges 122. The line of perforations 125 enables the portions of the flanges outwardly therefrom to separate easily from the main flange and remain adhered to the cover and the cover is pulled upwardly. Opening of the cover causes all of the peripheral flanges 120, 121 and 122 to split and adhere partially to the cover as it is rotated upward. The cover rotates about and is hingedly connected to the tray by the back hinge line 126 which connects the back flange 123 to the back panel 115. The container embodiment 110 provides complete sealing closure of the cover to the tray around the entire periphery of the tray for maximum protection of the articles therein during transit and storage, and is intended to be used where the entire contents of the tray will be consumed upon opening.

It is understood that the invention is not confined to the particular construction and arrangement of parts herein illustrated and described, but embraces all such modified forms thereof as come within the scope of the following claims.

I claim:

1. A container comprising:

(a) a formed plastic tray having a bottom and sides and peripheral edges defining the top opening in said tray, said peripheral edges including front and back edges and a pair of lateral side edges, and outwardly extending flanges affixed to and extending outwardly from the front, back and side peripheral edges of said tray, (b) a substantially flat paperboard cover having outer and inner sides, the inner side of said cover being adhered to said peripheral flanges of said tray in position covering the open top thereof, said cover having score lines cut partially through the inner side of said cover at positions inwardly adjacent to the front edge of said tray and adjacent to the lateral side edges of said tray and a hinge line formed therein adjacent to the back edge of said tray, said cover additionally having a score line cut partially through the outer side of said cover substantially parallel to and spaced outwardly of the cut score line in the inner side of said cover at the front edge of said tray, said outer side cut score line extending substantially the length of the front edge of said tray and intersecting said inner cut score line at its ends, said cover being adhered to said front flange only at the area of said cover between said outer side cut score line and the edge of said cover, whereby when said cover is pulled upwardly from the tray by a user, the cover will split at the areas of adhesion between said cover and the flanges of said tray along the lateral sides thereof and between said outer and inner side cut score lines at the front edge of said tray, and will hingedly open about its hinge line at the back edge of said tray, the splitting of the cover between said outer and inner cut score lines leaving a first split thickness locking flap remaining on the tray at the front edge thereof with a second overlapping split thickness locking flap at the front of the remaining of the cover which may be engaged under the first locking flap to allow reclosure of the cover on said tray.

2. The container of claim 1 wherein said tray is a thermo-formed plastic blister tray.

3. The container of claim 1 wherein said hinge line along the back edge of said tray on said cover is formed as a cut score line partially through the inner side of said cover to allow rotation of the remainder of the cover about said cut score line upon opening of the cover.

4. The container of claim 1 wherein said cover is sealed to said tray by a heat sealed polyethylene adhesive.

5. The container of claim 1 wherein the inner side of said cover is sealed with a polyethylene sealer.

6. The container of claim 1 including a notch formed on one of said side flanges at a position adjacent to the front edge of said tray, and wherein said cover is not adhered to said tray at an area of the flange proximate to said notch to provide an initial opening position for pulling off said cover from said tray.

7. The container of claim 1 wherein the outside lateral edges of said cover are in substantial registry with the outside lateral edges of said tray to facilitate splitting of said cover along the lateral edges during opening.

8. The container of claim 1 wherein cut score lines are formed in the inner side of said cover substantially in registry with the outside lateral edges of said tray to facilitate splitting of said cover along the lateral edges during opening.

9. A container comprising:

(a) an open topped tray having a bottom, and at least front, back, and lateral side walls connected together and having a top peripheral edge defining the top opening in said tray, a front outwardly extending flange affixed to and extending outward from the front peripheral edge of said tray, and a pair of outwardly extending flanges affixed to and extending from the lateral peripheral edges of said tray;

(b) a substantially flat paperboard cover having outer and inner sides and being hingedly connected to the back edge of said tray, cut score lines formed in the inner side of said cover adjacent and parallel to said lateral side edges of said tray with the area between said inner lateral cut score lines and the edges of said cover being adhered to said lateral flanges of said tray, whereby when said cover is pulled upwardly by a user from the flanges of the tray, the cut scored paperboard cover will slit in the area between said lateral cut score lines and the lateral edges of the cover to leave a split thickness layer of paperboard remaining adhered to said lateral flanges and a split thickness layer of paperboard remaining integral with the rest of the cover, and wherein said cover additionally has a score line cut partially through the inner side of said cover adjacent and parallel to said front edge of said tray and another score line cut partially through the outer side of said cover substantially parallel to and spaced outwardly of the cut score line in the inner side of said cover at the front edge of said tray, said outer side cut score line extending substantially the length of the front edge of said tray and intersecting said inner cut score line at its ends, said cover being adhered to said front flange only at the area of said cover between said outer side cut score line and the edge of said cover, whereby when said cover is pulled upwardly from said tray by a user said paperboard cover will also split between said outer and inner side cut score lines and will leave a first split thickness locking flap remaining on the tray at the front edge thereof with a second overlapping split thickness locking flap at the front of the remainder of the cover which may be engaged under the first locking flap to allow reclosure of the cover on said tray.

10. The container of claim 9 wherein said tray and flanges thereof are thermo-formed plastic.

* * * * *